US010118749B1

(12) United States Patent
Williams

(10) Patent No.: US 10,118,749 B1
(45) Date of Patent: Nov. 6, 2018

(54) TOOTH POWDER CONTAINER SYSTEM

(71) Applicant: Donald Williams, Miilton, FL (US)

(72) Inventor: Donald Williams, Miilton, FL (US)

( * ) Notice: Subject to any disclaimer, the term of this patent is extended or adjusted under 35 U.S.C. 154(b) by 0 days.

(21) Appl. No.: 15/195,679

(22) Filed: Jun. 28, 2016

Related U.S. Application Data

(60) Provisional application No. 62/211,641, filed on Aug. 28, 2015.

(51) Int. Cl.

| | |
|---|---|
| ***B65D 65/02*** | (2006.01) |
| ***B65D 75/58*** | (2006.01) |
| ***B65D 75/28*** | (2006.01) |
| ***B65D 85/00*** | (2006.01) |
| ***B65D 65/42*** | (2006.01) |

(52) U.S. Cl.
CPC ..... *B65D 75/5805* (2013.01); *B65D 65/02* (2013.01); *B65D 65/42* (2013.01); *B65D 75/28* (2013.01); *B65D 85/70* (2013.01)

(58) Field of Classification Search
CPC .... B65D 75/5805; B65D 65/02; B65D 65/42; B65D 75/28; B65D 85/70; B65D 75/5833; A61C 2202/00; A61J 1/10; A61J 1/2027
USPC ..... 229/87.05; 383/200, 207, 209, 116, 204, 383/906; 206/63.5; 222/92
See application file for complete search history.

(56) References Cited

U.S. PATENT DOCUMENTS

| | | | | |
|---|---|---|---|---|
| 4,881,644 | A * | 11/1989 | Norquest | A61F 13/55185 206/363 |
| 2009/0181133 | A1* | 7/2009 | Luber | B65D 75/40 426/108 |
| 2009/0260997 | A1* | 10/2009 | Rovelli | A61C 9/00 206/63.5 |
| 2014/0044381 | A1* | 2/2014 | Ulstad | B65D 5/2057 383/207 |

* cited by examiner

*Primary Examiner* — Christopher Demeree

(57) ABSTRACT

A tube has left and right edges spaced by a length, semi-cylindrical top and bottom edges spaced by a height, and upper and lower faces spaced from and parallel with each other at a central section. The central section is equally spaced from the left edge and the right edge. The upper and lower faces are in facing contact with each other adjacent to the left edge and adjacent to the right edge.

1 Claim, 3 Drawing Sheets

FIG. 1
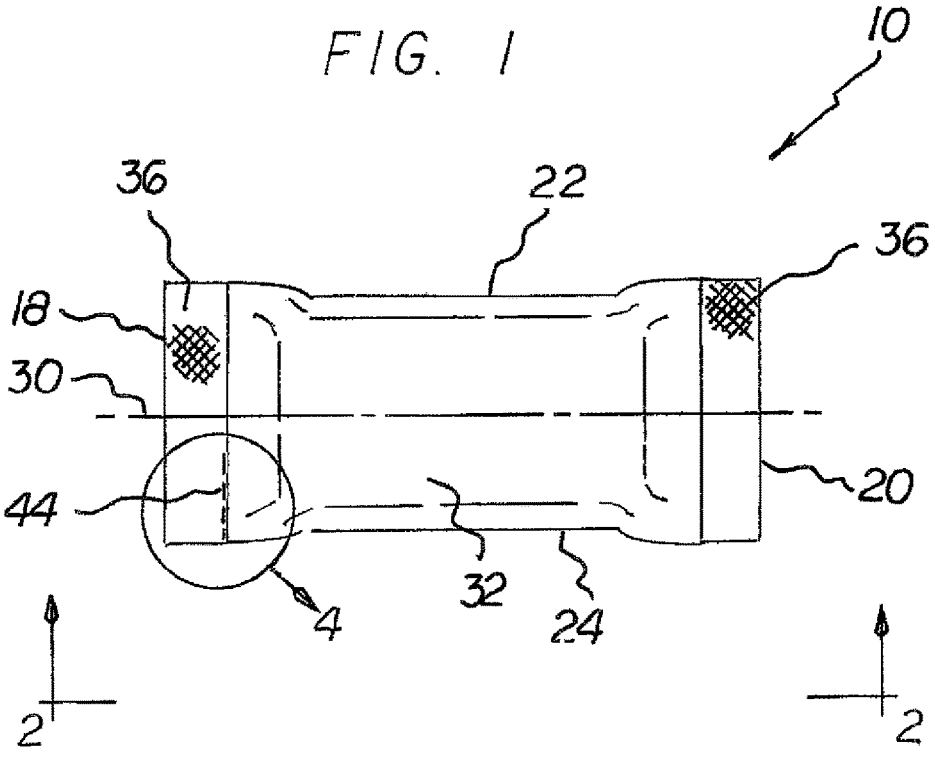
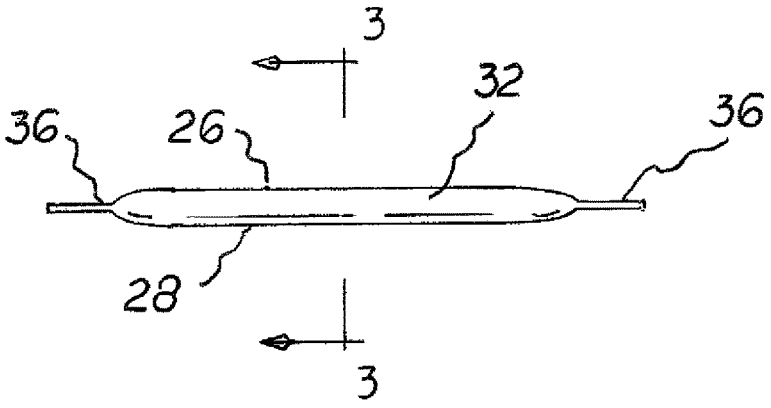
FIG. 2

FIG. 3
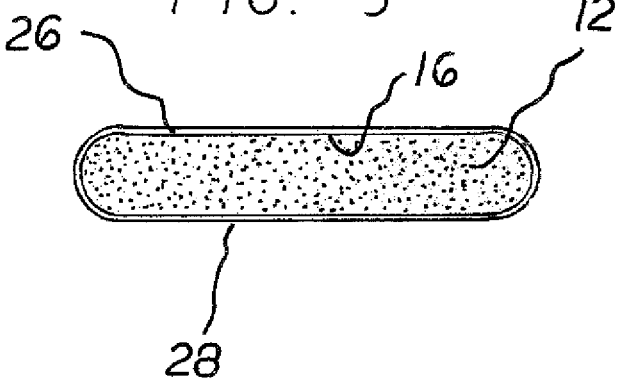
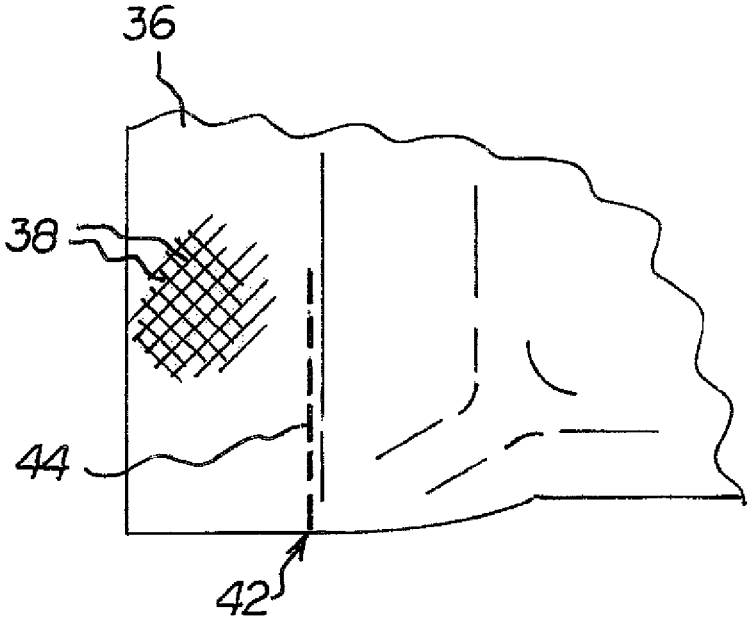
FIG. 4

FIG. 5
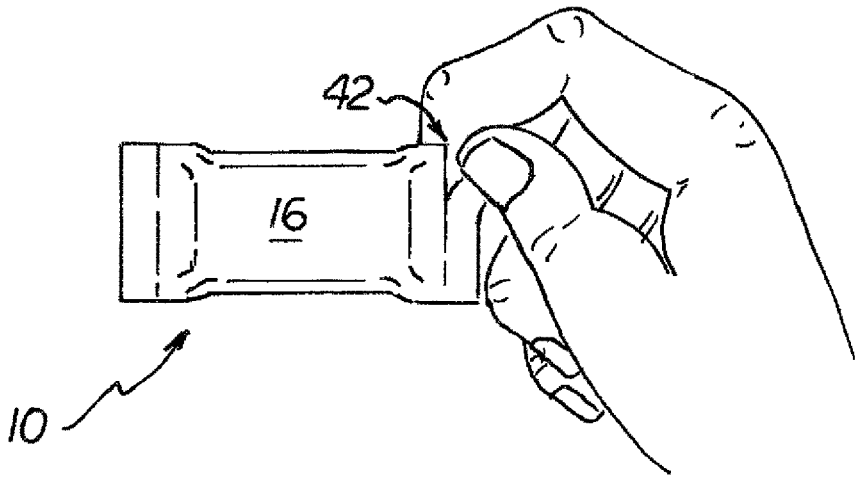
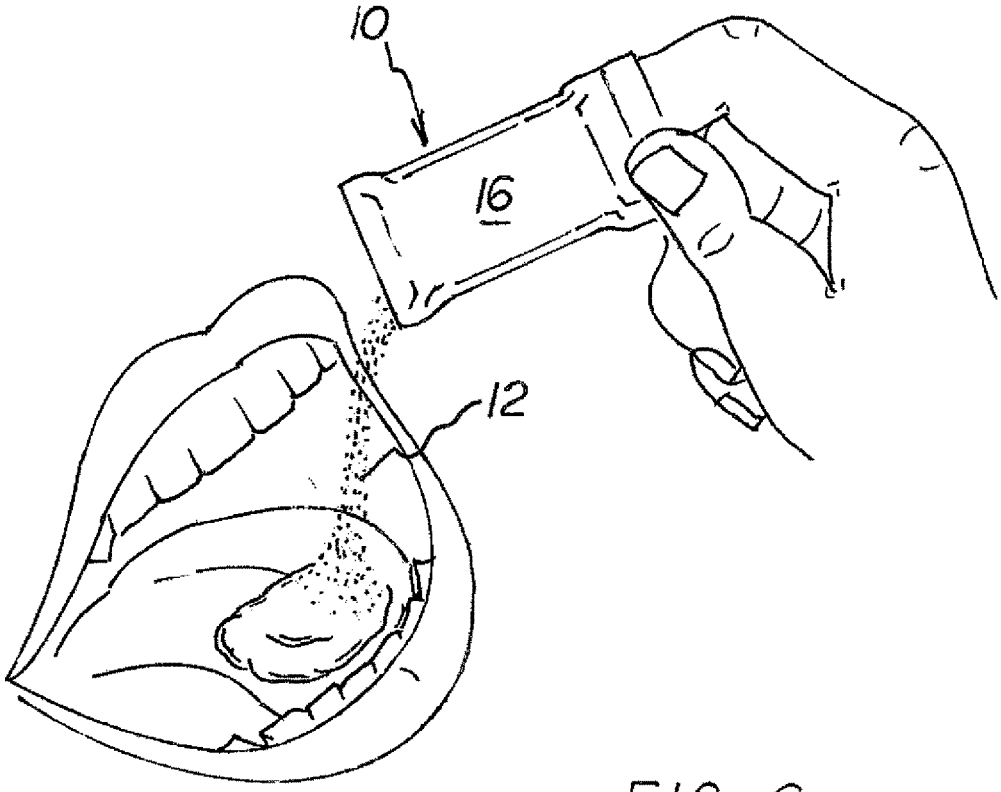
FIG. 6

TOOTH POWDER CONTAINER SYSTEM

RELATED APPLICATION

The present application is based upon Provisional Application No. 62/211,641 filed Aug. 28, 2015, the subject matter of which is incorporated herein by reference and the priority of which is claimed.

BACKGROUND OF THE INVENTION

Field of the Invention

The present invention relates to a tooth powder container system and more particularly pertains to storing a precise single dose of tooth powder and dispensing the precise single dose, the storing and the dispensing being done in a safe, sanitary, convenient, and economical manner.

SUMMARY OF THE INVENTION

In view of the disadvantages inherent in the known types of container systems of known designs and configurations now present in the prior art, the present invention provides an improved tooth powder container system. As such, the general purpose of the present invention, which will be described subsequently in greater detail, is to provide a new and improved tooth powder container system and method which has all the advantages of the prior art and none of the disadvantages.

To attain this, for a broad perspective, the present invention essentially comprises a tube with left and right edges spaced by a length, semi-cylindrical top and bottom edges spaced by a height, and upper and lower faces spaced from and parallel with each other at a central section. The central section is equally spaced from the left edge and the right edge. The upper and lower faces are in facing contact with each other adjacent to the left edge and adjacent to the right edge.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tooth powder container system which has all of the advantages of the prior art container systems of known designs and configurations and none of the disadvantages.

It is another object of the present invention to provide a new and improved tooth powder container system which may be easily and efficiently manufactured and marketed.

It is a further object of the present invention to provide a new and improved tooth powder container system which is of durable and reliable constructions.

An even further object of the present invention is to provide a new and improved tooth powder container system which is susceptible of a low cost of manufacture with regard to both materials and labor. This invention is then susceptible of low prices of sale to the consuming public, thereby making such tooth powder container system economically available to the buying public.

Lastly, it is an object of the present invention to provide a tooth powder container system for storing a precise single dose of tooth powder and for dispensing the precise single dose, the storing and the dispensing being done in a safe, sanitary, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a tooth powder container system constructed in accordance with the principles of the present invention.

FIG. 2 is a bottom view of the system taken along line 2-2 of FIG. 1.

FIG. 3 is a cross sectional view taken along line 3-3 of FIG. 2.

FIG. 4 is an enlarged showing of a portion of the tube taken at circle 4 of FIG. 1.

FIG. 5 is a perspective showing of the system being held prior to use.

FIG. 6 is a perspective showing of the system being held after opening while pouring.

The same reference numerals refer to the same parts throughout the various figures.

DESCRIPTION OF THE PREFERRED EMBODIMENT

With reference now to the drawings, and in particular to FIG. 1 thereof, the preferred embodiment of the new and improved tooth powder container system embodying the principles and concepts of the present invention and generally designated by the reference numeral 10 will be described.

The present invention, the tooth powder container system 10 is comprised of a tube. The tube is so as to attain the desired objective.

From a specific perspective, the invention of the present application is a tooth powder container system 10, for storing a precise single dose of tooth powder 12. A tube 16 is provided. The tube has a left edge 18. The tube has a right edge 20. The right edge and the left edge are provided linear and parallel with each other. The left edge and the right edge are spaced by a length of 3.25 inches, plus or minus 20 percent. The tube has a top edge 22. The tube has a bottom edge 24. The top edge and the bottom edge are semi-cylindrical. The top edge and the bottom edge are spaced by a height of 1.50 inches, plus or minus 20 percent. The tube has an upper face 26. The tube has a lower face 28. The tube has a central axis 30. The upper face and the lower face are parallel with each other and spaced by 0.1875 inches, plus or minus 20 percent for a majority of the length thereby forming a central section 32. The central section has a length of 2.75 inches, plus or minus 20 percent. The central section is equally spaced from the left edge and the right edge. The upper face and the lower face are spaced by 0.1875 inches, plus or minus 20 percent. The upper face and the lower face are in facing contact with each other adjacent to the left edge and adjacent to the right edge. The tube is fabricated of plastic. The plastic has a coating of water repellent material to abate slipping during handling while wet.

A coupling assembly 36 is provided. The coupling assembly includes coupling lines 38. The coupling lines are adjacent to the left edge and adjacent to the right edge. The coupling lines join the upper extent and the lower extent exteriorly of the central section through heat and pressure applied at the lines. The coupling lines are in a criss-cross manner with from 3 to 4 coupling lines per inch.

Further provided is a separation assembly 42. The separation assembly includes perforations 44. The perforations extend through the coupling lines adjacent to the left edge. The perforations extend from the bottom edge halfway to the top edge.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tooth powder container system (10) for storing a precise single dose of tooth powder (12) and for dispensing the precise single dose, the system comprising, in combination:

a quantity of tooth powder;

a tube (16) having a left edge (18) and a right edge (20), the left edge and the right edge being linear and parallel with each other and spaced by a length of 3.25 inches, plus or minus 20 percent, the tube having a top edge (22) and a bottom edge (24), the tube having a length, the tube having a central section (32), the top edge and the bottom edge being semi-cylindrical, the tube having a semi-circular configuration extending over a majority of the length of the tube and having a lesser width at the central section of the tube compared to the edges of the tube, the top edge and the bottom edge being spaced by a height of 1.50 inches, plus or minus 20 percent, the tube having an upper face (26) and a lower face (28) and a central axis (30), the upper face and the lower face being parallel with each other and spaced by 0.1875 inches, plus or minus 20 percent for a majority of the length thereby forming the central section (32) with a length of 2.75 inches, plus or minus 20 percent, the central section being equally spaced from the left edge and the right edge, the upper face and the lower face being arcuate in a semi-circular configuration adjacent to the bottom edge, the upper face and the lower face being arcuate in a semi-circular configuration adjacent to the top edge, the tube being fabricated of plastic with a coating of water repellent material to abate slipping during handling while wet;

a coupling assembly (36) formed of coupling lines (38) adjacent to the left edge and adjacent to the right edge, the coupling lines joining the upper face and the lower face exteriorly of the central section through heat and pressure applied at the lines, the coupling lines being in a criss-cross manner with from 3 to 4 coupling lines per inch; and a separation assembly (42), the separation assembly including perforations (44) extending through the coupling lines adjacent to the left edge, the perforations extending from the bottom edge halfway to the top edge.

* * * * *